US008203522B2

(12) United States Patent
Stessen et al.

(10) Patent No.: US 8,203,522 B2
(45) Date of Patent: Jun. 19, 2012

(54) METHOD AND DEVICE FOR DRIVING AN IMAGE DISPLAY APPARATUS AND CONTROLLING A DISPLAY BACKLIGHT BASED ON CONTENT

(75) Inventors: Jeroen Hubert Christoffel Jacobus Stessen, Eindhoven (NL); Johannes Gerardus Rijk Van Mourik, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 789 days.

(21) Appl. No.: 12/300,841

(22) PCT Filed: Apr. 26, 2007

(86) PCT No.: PCT/IB2007/051544

§ 371 (c)(1), (2), (4) Date: Nov. 14, 2008

(87) PCT Pub. No.: WO2007/132370

PCT Pub. Date: Nov. 22, 2007

(65) Prior Publication Data

US 2009/0115766 A1 May 7, 2009

(30) Foreign Application Priority Data

May 15, 2006 (EP) ..... 06113910

(51) Int. Cl.
*G09G 3/36* (2006.01)

(52) U.S. Cl. ..... 345/102

(58) Field of Classification Search ..... 345/87–104
See application file for complete search history.

(56) References Cited

U.S. PATENT DOCUMENTS

| | | | | |
|---|---|---|---|---|
| 2002/0036615 | A1 | 3/2002 | Karamoto | |
| 2003/0222884 | A1 * | 12/2003 | Ikeda et al. | 345/589 |
| 2004/0100437 | A1 * | 5/2004 | Hunter et al. | 345/102 |
| 2004/0113906 | A1 | 6/2004 | Lew et al. | |
| 2004/0201562 | A1 * | 10/2004 | Funamoto et al. | 345/89 |
| 2005/0057486 | A1 | 3/2005 | Aoki et al. | |
| 2006/0267923 | A1 * | 11/2006 | Kerofsky | 345/102 |
| 2007/0120806 | A1 * | 5/2007 | Schmidt et al. | 345/102 |

FOREIGN PATENT DOCUMENTS

| | | | |
|---|---|---|---|
| WO | 2005093703 | A1 | 10/2005 |
| WO | 2005109391 | A1 | 11/2005 |
| WO | 2005119639 | A1 | 12/2005 |
| WO | WO 2005119639 | A1 * | 12/2005 |
| WO | WO 2007029420 | * | 3/2007 |

OTHER PUBLICATIONS

Naehyuck Chang, et al: DLS: Dynamic Backlight Luminance Scaling of Liquid Crystal Display, IEEE Transactions on Very Large Scale Integration (VLSI) Systems, vol. 12, No. 8, Aug. 2004, pp. 837-846.

* cited by examiner

*Primary Examiner* — Chanh Nguyen
*Assistant Examiner* — Navin Lingaraju

(57) ABSTRACT

A method for driving an image display device having a backlight lamp and a display screen includes receiving an image data signal; and based the image data signal, calculating a content-related backlight control signal for the backlight lamp for setting the intensity of the backlight. The method further includes generating an average signal that represents a time-average of the power consumed by the backlight lamp; comparing the average signal with a reference signal; and based on the calculated content-related backlight control signal and taking into account the result of the comparison, generating an actual backlight control signal for the backlight lamp.

12 Claims, 9 Drawing Sheets

METHOD AND DEVICE FOR DRIVING AN IMAGE DISPLAY APPARATUS AND CONTROLLING A DISPLAY BACKLIGHT BASED ON CONTENT

FIELD OF THE INVENTION

The present invention relates in general to a method and device for driving an image display apparatus, such as for instance in a television, a monitor, etc.

In general, the invention can be applied to several types of image display apparatus having a backlight. In the following, the invention will be described for an image display device of the LCD type, but it is to be noted that it is not intended to restrict the invention to LCD image display devices.

BACKGROUND OF THE INVENTION

In an image display device, an image consists of a large number of image points, each having a specific grey value or color and a specific brightness. In a specific class of image display devices, a viewer is watching a display screen behind which a light source is arranged, the so-called backlight. The display screen comprises a plurality of pixels which can be controlled to pass light or to block light. In a specific embodiment, a pixel is implemented as a liquid crystal cell. A controller receives a video signal with image data, and on the basis of these image data it generates control signals for the liquid crystal cells. In the following, a control signal for pixel cells will be indicated as $S_{CP}$, and it will be assumed to have a minimum value 0 and a maximum value 1.

The image data can range from perfect black to perfect white. The image data are translated by the controller to a certain value for the control signal $S_{CP}$. In the case of perfect black, the brightness data in de video signal will be assumed to have a minimum value 0. It is noted that, in response to receiving a control signal $S_{CP}=0$, the pixel cell should block all light from the backlight. In practice, however, a pixel cell will always "leak" to some extent. In the case of perfect white, the brightness data in de video signal will be assumed to have a maximum value 1. It is noted that, in response to receiving a control signal $S_{CP}=1$, the pixel cell should pass all light from the backlight. In practice, however, a pixel cell will always reflect and/or absorb to some extent. So, generally speaking, the transmission rate of a pixel cell, indicated as H, will range from a minimum value $\alpha$ to a maximum value $\beta$, wherein $0<\alpha<\beta<1$.

In an actual image, the darkest portions may be lighter-than-black and the brightest portions may be darker-than-white. Thus, the transmission rate for all pixels of the image will be in a range from $\alpha^*$ to $\beta^*$, with $\alpha<\alpha^*<\beta^*<\beta$. The values $\alpha^*$ en $\beta^*$ determine the contrast of the image: a high contrast ratio means that the distance between $\alpha^*$ and $\beta^*$ is as large as possible.

Apart from the actual value of the transfer rate H, the amount of light $I_P$ emanating from a pixel, as viewed by the viewer, depends on the brightness of the backlight, in other words the intensity $I_{BL}$ of the light generated by the backlight. This might be expressed in a formula as follows:

$$I_P=H\cdot I_{BL} \tag{1}$$

Thus, with a certain setting of the intensity $I_{BL}$ of the backlight, the brightness $I_P$ of a pixel can range from $\alpha\cdot I_{BL}$ to $\beta\cdot I_{BL}$.

Under certain circumstances, it may be desirable to increase the light output. This may for instance be the case if the level of the ambient light is relatively high. Increasing the light output may be done by shifting the range $[\alpha^*,\beta^*]$ to higher values, or at least by shifting the upper limit $\beta^*$ of this range to higher values.

On the other hand, under certain other certain circumstances, it may be desirable to decrease the light output. This may for instance be the case if the level of the ambient light is relatively low. Decreasing the light output may be done by shifting the range $[\alpha^*,\beta^*]$ to lower values, or at least by shifting the lower limit a* of this range to lower values.

However, increasing or decreasing the light output can also be achieved by increasing or decreasing the intensity $I_{BL}$ of the backlight.

From formula 1, it follows that the same pixel brightness $I_P$ can be achieved for different settings of the brightness $I_{BL}$ of the backlight. If the brightness $I_{BL}$ of the backlight is multiplied by a certain factor X, and simultaneously the transfer rate H of a pixel cell is divided by the same factor X, the resulting product $(X\cdot I_{BL})\cdot(H/X)=I_P$. This fact is utilized in backlight boosting and backlight dimming.

In the case of backlight boosting, the intensity $I_{BL}$ of the backlight is increased. This can be used to enhance white parts of an image. By increasing the backlight intensity $I_{BL}$, those parts appear to be "better white" for the viewer. In grey parts of the image, the grey value can be maintained by simultaneously reducing the control signal $S_{CP}$ for the pixel cells, so that the pixels cells pass less light.

In the case of backlight dimming, the brightness $I_{BL}$ of the backlight is decreased. This can be used to enhance black parts of an image. By decreasing the backlight intensity $I_{BL}$, those parts appear to be "better black" for the viewer. In grey parts of the image, the grey value can be maintained by simultaneously increasing the control signal $S_{CP}$ for the pixel cells, so that the pixels cells pass more light.

By alternating backlight boosting and backlight dimming, the overall contrast ratio of the display device can be enhanced, and energy can be saved.

An image display device is designed for a certain nominal setting of the backlight light source. In this nominal setting, the backlight light source consumes a certain amount of power, and consequently it generates a certain amount of heat; the image display device is designed to handle this amount of heat. It should be clear that changing the contrast range $[\alpha^*,\beta^*]$ of the transmission rate of the screen pixels does not change the power consumption of the backlight. When using backlight dimming, energy is saved, but when using backlight boosting, the backlight light source produces more heat than the image display device is designed to handle. If this situation continues for a prolonged amount of time, the apparatus may become too hot. This problem might be mitigated by using additional cooling means, but this would add to the hardware costs and the energy bill of the apparatus.

SUMMARY OF THE INVENTION

The present invention proposes a method for driving an image display device using backlight dimming and backlight boosting such that, on average, the power consumed by the backlight does not exceed a predetermined power rating. In darker scenes, the backlight is dimmed and the display control signals are increased. In very bright scenes, the backlight can temporarily be boosted.

The predetermined power setting may be equal to the nominal power setting; in that case, brighter images are achieved. However, the predetermined power setting may also be lower than the nominal power setting; in that case, an overall power saving for the display apparatus is achieved.

Backlight dimming saves energy, but backlight boosting spends more energy. In order not to exceed the predetermined average, it is only possible to perform backlight boosting if it is preceded by a period of backlight dimming. It might be said that backlight dimming provides an energy reserve that can be consumed to perform backlight boosting. However, such reserve is limited. The present invention provides a method for backlight boosting which uses the energy reserve in an efficient manner and, when the energy reserve gets exhausted, reduces the excess energy consumption in an effective manner.

BRIEF DESCRIPTION OF THE DRAWINGS

These and other aspects, features and advantages of the present invention will be further explained by the following description with reference to the drawings, in which same reference numerals indicate same or similar parts, and in which.

DETAILED DESCRIPTION OF THE INVENTION

Figure 1:
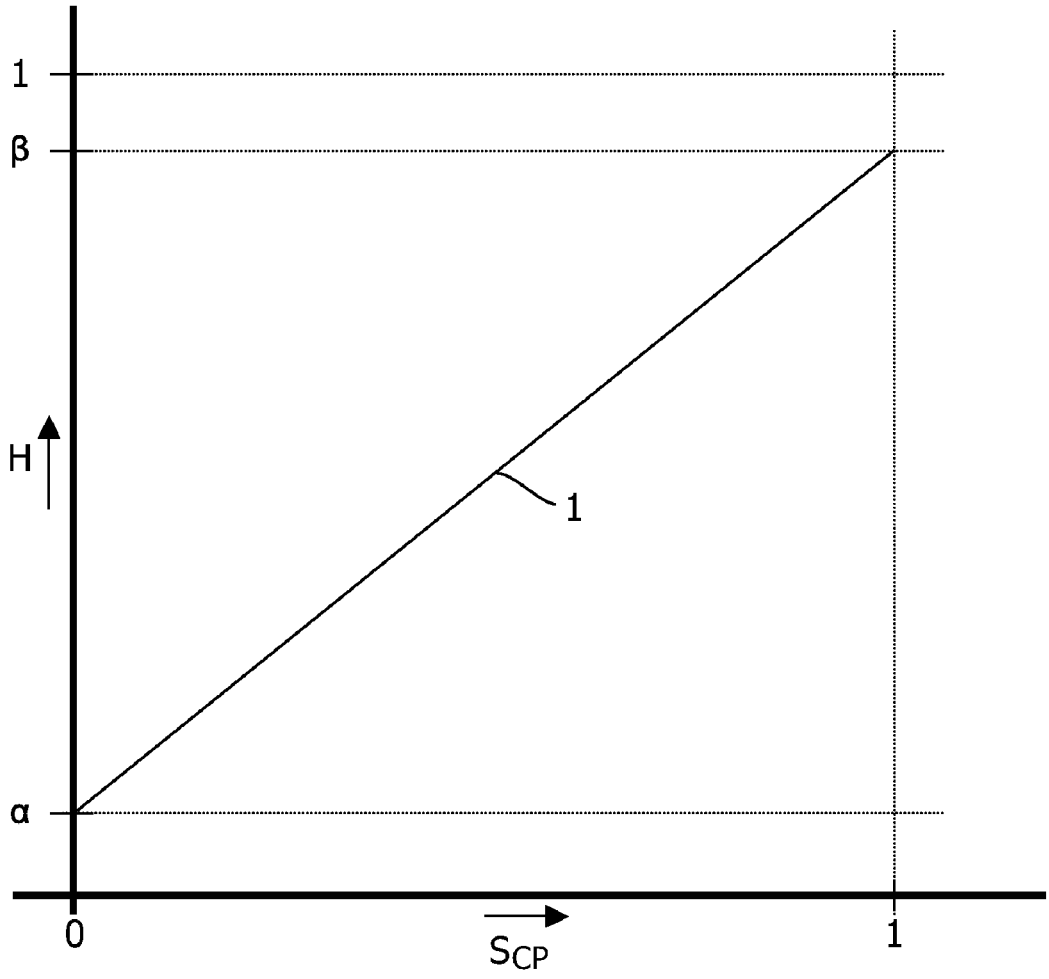
FIG. 1 schematically illustrates a transmission characteristic of a pixel.

FIG. 1 is a graph schematically illustrating a transmission characteristic of a pixel, for instance an LCD cell. The horizontal axis represents a control signal $S_{CP}$, ranging from 0 for minimum transmission to 1 for maximum transmission. The vertical axis represents a transmission ratio H of the pixel, ranging from 0 for perfectly blocking to 1 for 100% transmission. Line 1 shows that for control signal $S_{CP}=0$, the transmission ratio H(0)=$\alpha>0$, indicating that the minimum transmission of a pixel is always somewhat larger than zero. Further, line 1 shows that for control signal $S_{CP}=1$, the transmission ratio H(1)=$\beta<1$, indicating that the maximum transmission of a pixel is always less than 100%. The characteristic line 1 is shown as a straight line, but this is not essential.

Figure 2:
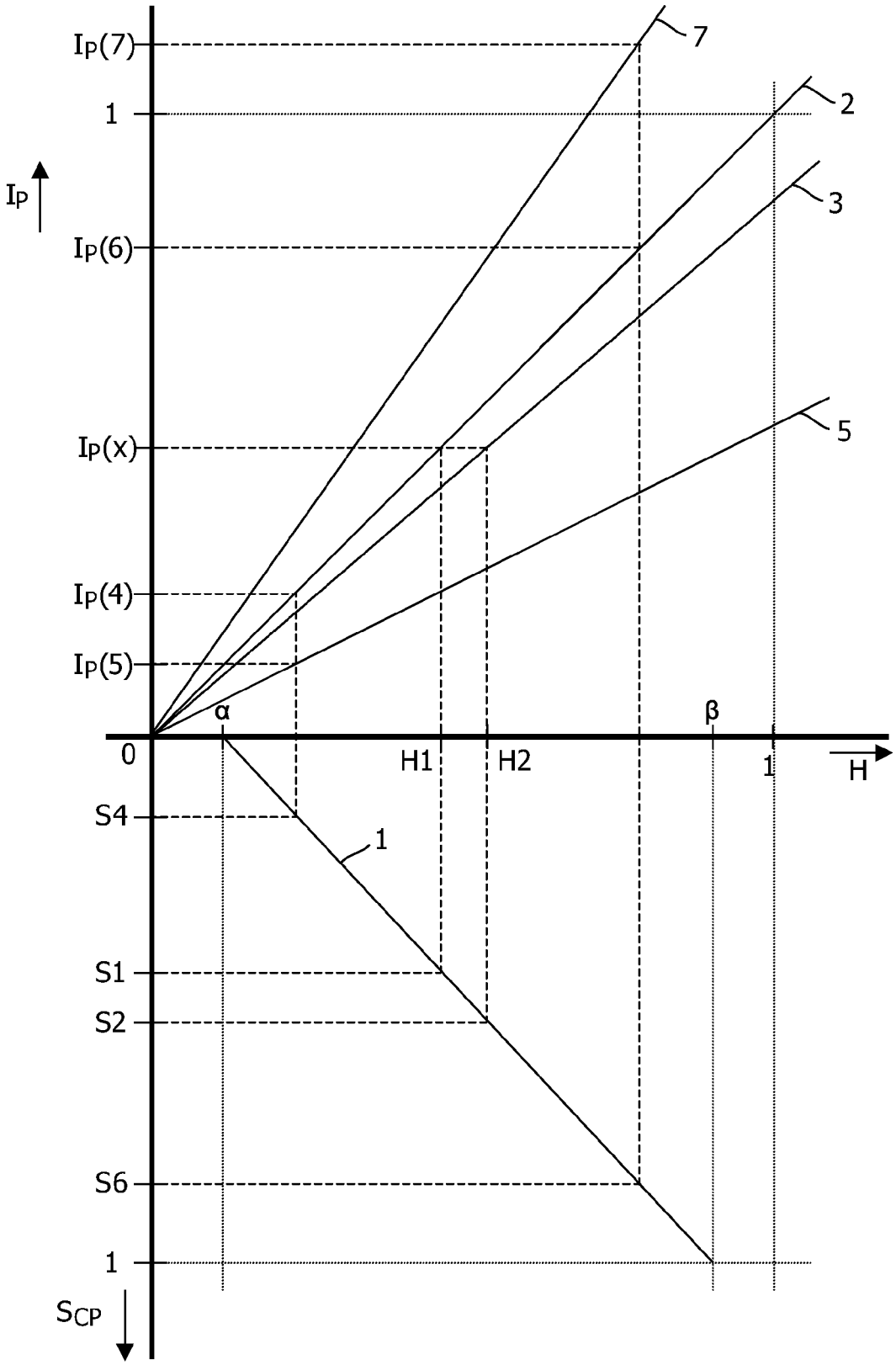
FIG. 2 schematically illustrates backlight dimming.

FIG. 2 is a graph schematically illustrating backlight dimming. The vertical axis downwards represents the control signal $S_{CP}$, and the horizontal axis represents the transmission ratio H of the pixel, so that quadrant IV of this graph corresponds to the graph of FIG. 1. The vertical axis upwards represents the amount of light $I_P$ emanating from the pixel, also indicated as pixel intensity (normalized on the nominal backlight intensity). It is assumed that the pixel intensity $I_P$ obeys the above formula (I). Thus, at a certain nominal backlight intensity $I_{BL}$, represented by line 2, if the pixel control signal $S_{CP}$ has a certain value S1, the transmission ratio H of the pixel has a certain value H1 and the pixel intensity $I_P$ has a certain value $I_P$(x). The same value $I_P$(x) is achieved if the backlight intensity is reduced (indicated by line 3) and the pixel control signal $S_{CP}$ is suitably increased to an increased value S2, in which case the transmission ratio H of the pixel has an increased value H2.

In FIG. 2, it can also be seen that, if the pixel control signal $S_{CP}$ is maintained, reducing the backlight intensity causes a reduction of the pixel intensity $I_P$, which particularly can be used to enhance "black" performance. Assume a dark scene, associated with a certain low value S4 of the pixel control signal $S_{CP}$. With the nominal backlight intensity $I_{BL}$ (line 2), the pixel intensity $I_P$ has a relatively high value $I_P$(4). With reduced backlight intensity $I_{BL}$ (line 5), the pixel intensity $I_P$ has a substantially lower value $I_P$(5).

Conversely, backlight boosting results in higher pixel intensity $I_P$ when the pixel control signal $S_{CP}$ is maintained, which can be used to enhance "white" performance. Assume a bright scene, associated with a certain high value S6 of the pixel control signal $S_{CP}$. With the nominal backlight intensity $I_{BL}$ (line 2), the pixel intensity $I_P$ has a relatively low value $I_P$(6). With increased backlight intensity $I_{BL}$ (line 7), the pixel intensity $I_P$ has a substantially higher value $I_P$(7).

It is noted that backlight boosting and backlight dimming are known per se. Backlight dimming can for instance be performed by driving a backlight lamp with a duty cycle less than 1. Backlight boosting can for instance simply be implemented if the nominal power setting of a backlight lamp corresponds to a duty cycle less than 1: in that case, the duty cycle can be increased. If, in order to improve the display performance in the case of moving images, a backlight lamp is normally driven at a duty cycle of 30%, a boost factor of over 300% is available.

Figure 3:
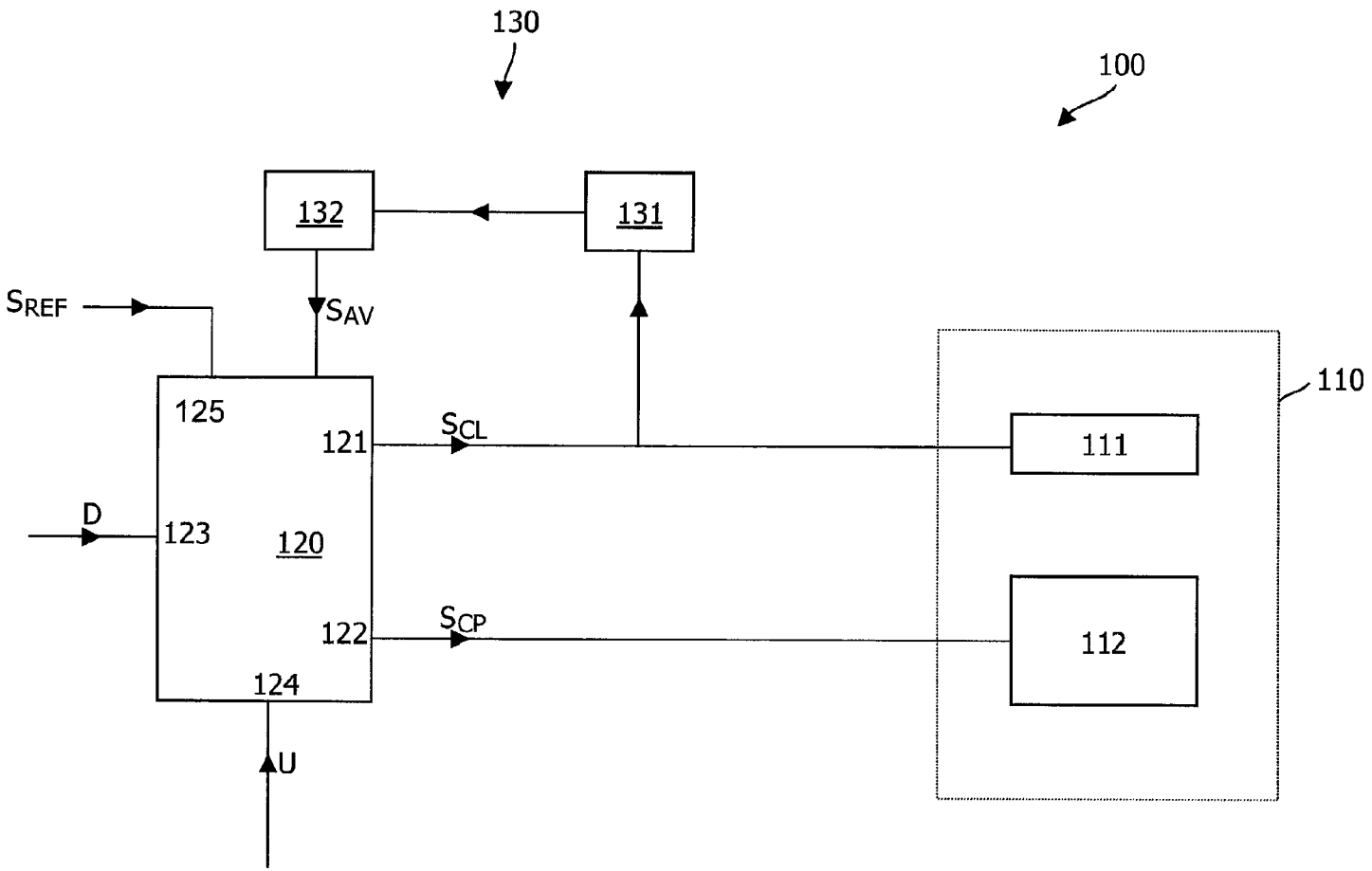
FIG. 3 is a block diagram schematically illustrating a display apparatus.

FIG. 3 is a block diagram schematically illustrating a display apparatus 100, comprising a display device 110 and a controller 120. The display device 110 comprises at least one backlight lamp 111 and a display screen 112. It is noted that display devices with backlight are known per se. The backlight lamp may for instance be implemented as an array of fluorescent tube, or as an array of LEDs. The display screen may for instance be implemented as an array of LCD cells, or any other type of light valve.

The controller 120 has a light control output 121 coupled to the backlight 111, for communicating lamp control signals $S_{CL}$ to the backlight 111, and has a pixel control output 122 coupled to the display screen 112, for communicating pixel control signals $S_{CP}$ to the display screen 112. The controller 120 has an image input 123 for receiving image data D (video signals), and has a user control input 124 for receiving user control signals U. With the lamp control signals $S_{CL}$, the controller 120 controls the power setting of to the backlight 111; it is noted that the intensity or brightness of the backlight 111 is proportional to the lamp power in a good approximation.

Figure 4:
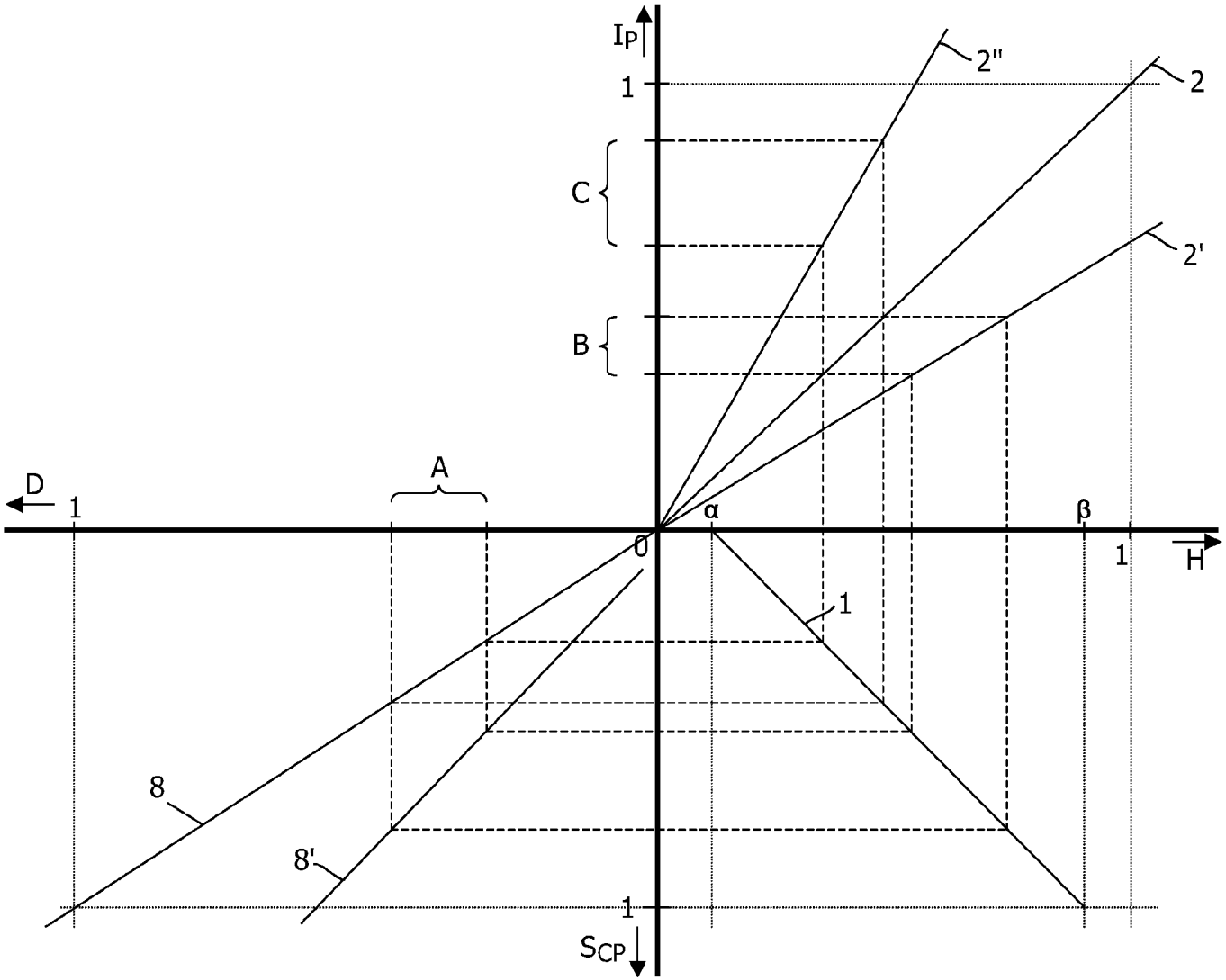
FIG. 4 is a graph comparable to FIG. 2, also including an apparatus characteristic.

FIG. 4 is a graph comparable to FIG. 2, but having added a left-hand horizontal axis representing image data D, wherein D=0 represents perfect black and D=1 represents perfect white. A line 8 represents a setting of brightness and contrast. If a scene is relatively dark, its pixel data will have values relatively close to zero (range A), resulting, with the nominal backlight intensity $I_{BL}$ (line 2), in relatively low level pixel intensity (range B). In such case, the controller 120 may reduce its lamp control signals $S_{CL}$ (line 2') and simultaneously increase its pixel control signals $S_{CP}$ (line 8') to achieve a reduction in power consumption while maintaining the image brightness. It should be clear that backlight dimming in this way is only possible in the case of relatively dark scenes, so it depends on the image contents.

On the other hand, if a scene is relatively bright, the controller 120 will try to increase the brightness of the backlight by increasing its lamp control signals $S_{CL}$ (line 2"), resulting in a wider area of higher pixel intensity (range C). As mentioned above, a problem may then be that the average power of the backlight becomes too high.

The solution to this problem proposed by the present invention is described below.

According to a first aspect of the present invention, the controller 120 sets a maximum to the backlight brightness, i.e. a maximum of the backlight power. This maximum, that will be indicated as $I_{BL}$(max), corresponds to a maximum $S_{CL}$(max) of the lamp control signals $S_{CL}$ to be outputted at the light control output 121. This is illustrated in FIG. 5, which is a graph illustrating a characteristic of the controller 120. The horizontal axis represents the calculated lamp control signals $S_{CL}$(D) as calculated by the controller 120 on the basis of the content of the data signals D and the user setting U alone. It is noted that the user setting U may be considered to be constant, but the content of the data signals D changes dynamically with time. The vertical axis represents the actually outputted lamp control signals $S_{CL}$(A). The graph of FIG. 5 shows a straight line 51 representing the relationship $S_{CL}(A)=\xi \cdot S_{CL}(D)$, wherein ξ is a factor which, by way of preferred example, in the following will be taken to be equal to 1. The graph of FIG. 5 further shows a horizontal line 52 representing the limit value $S_{CL}$(max). Curve 53 illustrates the behavior of the controller 120. For relatively low values of the calculated control signals $S_{CL}$(D), the controller 120 sets its output lamp control signals $S_{CL}$(A) to be equal to the lamp control signals $S_{CL}$(D) as calculated on the basis of the data content alone: in this region I, curve 53 follows line 51.

If the calculated control signals $S_{CL}$(D) exceed the maximum value $S_{CL}$(max), the controller 120 sets its output lamp control signals $S_{CL}$(A) to be equal to the maximum value $S_{CL}$(max); in this region III, curve 53 follows line 52.

It is possible that curve 53 follows lines 51 and 52 up till the intersection of these lines, to achieve a "hard" limitation. However, it is preferred that the limitation is softer, illustrated by a transition portion of curve 53 in the transition region II. Curve 53 follows line 51 between $S_{CL}(D)=0$ and $S_{CL}(D)=S_{CL}(1)$, indicated by a point P, wherein $S_{CL}(1)$ is a first transition value lower than the maximum value $S_{CL}$(max). Curve 53 follows line 52 for $S_{CL}(D) \geqq S_{CL}(2)$, indicated by a point Q, wherein $S_{CL}(2)$ is a second transition value higher than the maximum value $S_{CL}$(max). Between $S_{CL}(1)$ and $S_{CL}(2)$, curve 53 follows a path connecting points P and Q. Thus, the function that describes the relationship between $S_{CL}$(A) and $S_{CL}$(D) is a continuous function. Such path may be a straight line itself. Preferably, and as illustrated, such path is a curved path of which, in points P and Q, the end portions have the same direction as lines 51 and 52, respectively. The exact shape of this curved path is not essential, but it is preferred that it is a smooth shape. Preferably, the function that describes the relationship between $S_{CL}$(A) and $S_{CL}$(D) between $S_{CL}(1)$ and $S_{CL}(2)$ has a second derivative that is always negative.

The transition points P and Q may be calculated from the maximum value $S_{CL}$(max) in several ways. It is possible that the transition values are calculated according to $$S_{CL}(1)=S_{CL}(\max)-\Delta 1 \text{ and } S_{CL}(2)=S_{CL}(\max)+\Delta 2$$

Δ1 may be equal to Δ2.

It is also possible that the transition values are calculated according to $$S_{CL}(1)=S_{CL}(\max)/\alpha 1 \text{ and } S_{CL}(2)=S_{CL}(\max)\cdot\alpha 2$$

α1 may be equal to α2.

According to a second aspect of the present invention, the controller 120 is provided with a feedback loop 130 comprising a power calculator 131 and an average calculator 132. The power calculator 131 has an input receiving the actual lamp control signals $S_{CL}$(A) outputted by the controller 120, and is designed to calculate a value that is proportional to the power consumed by the backlight 111. Alternatively, it could be possible to actually measure the power consumption by the backlight 111, but that is more complicated. The average calculator 132 calculates a time-average of the power-representing value as calculated by the power calculator 131, and provides the result as an average signal $S_{AV}$ to the controller 120 at its power average input 126. The time constant of the average calculator 132 may be set in relationship with the warming-up and cooling-down properties of the display device 110; in general, the average calculator 132 may calculate the average over a time period in the order of several minutes.

In a relatively simple embodiment, the power consumed by the backlight 111 is proportional to the lamp control signals $S_{CL}$(A); in that case, a separate power calculator may be omitted, and the average calculator 132 may simply calculate the time-average of the lamp control signals $S_{CL}$(A). It is noted that circuitry or software for calculating a time-average are known per se.

According to a third aspect of the present invention, the controller 120 compares the average signal $S_{AV}$ with a predetermined reference value $S_{REF}$, received at a reference input 125. The reference value $S_{REF}$ may be stored in a memory (not shown) associated with the controller. The controller 120 sets the maximum value $S_{CL}$(max) proportional to the difference ($S_{REF}-S_{AV}$): if the average signal $S_{AV}$ becomes smaller, the maximum value $S_{CL}$(max) increases. Ultimately, the maximum value $S_{CL}$(max) may be higher than the practical range of backlight settings. If the average signal $S_{AV}$ rises, the controller 120 decreases the maximum value $S_{CL}$(max).

This is illustrated in an exaggerated manner in FIGS. 5A-E.

Figure 5A:
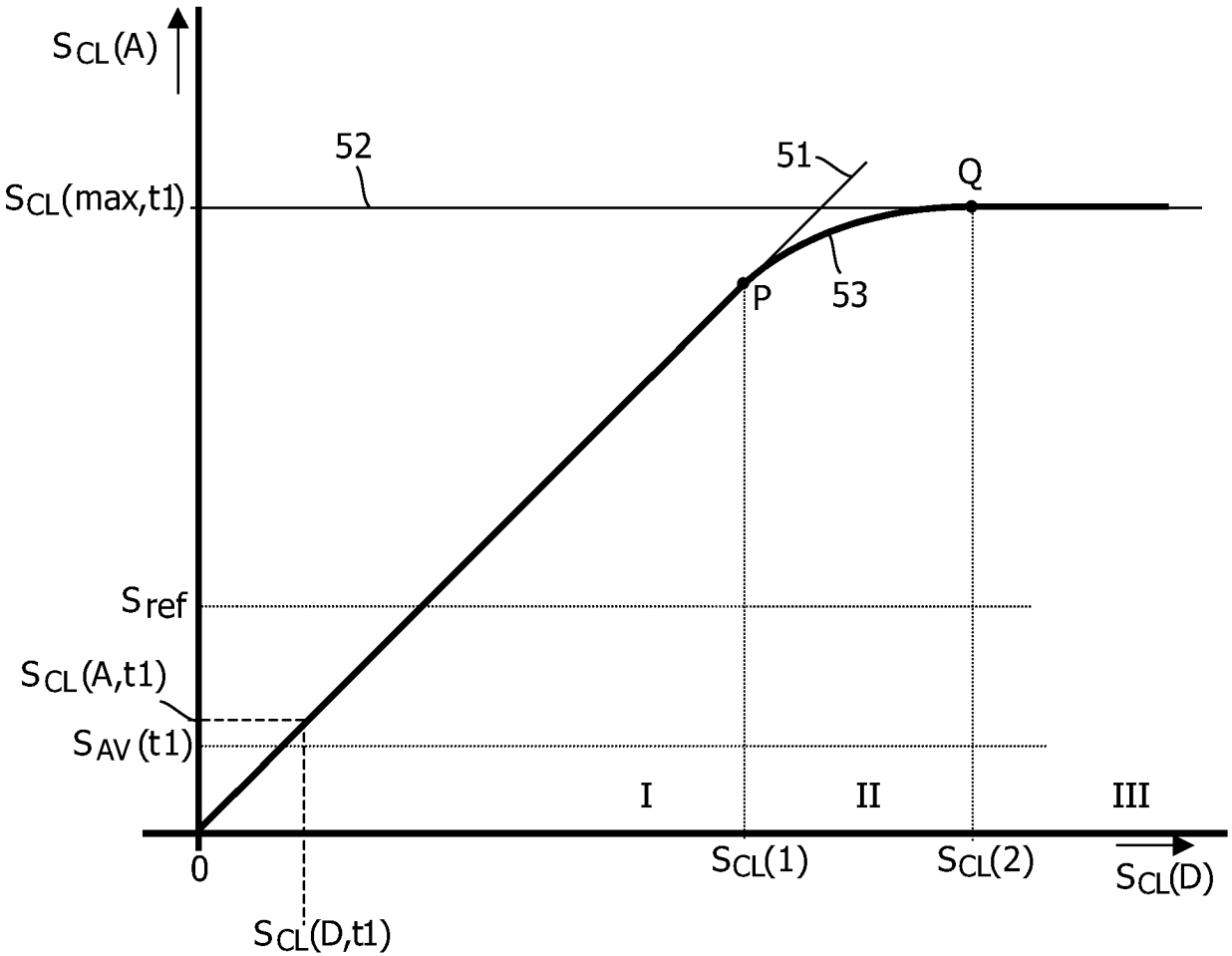
FIGS. 5A-E are graphs illustrating a backlight dimming characteristic of a controller of the apparatus of FIG. 3.

FIG. 5A illustrates a situation at a certain time t1. An assumed value for the reference value $S_{REF}$ is indicated. Assume that in this situation the average signal $S_{AV}$(t1) is substantially lower than the reference value $S_{REF}$, meaning that in the recent history the power consumption has been relatively low, i.e. a recent history of backlight dimming. Assume further that the calculated lamp control signal $S_{CL}$(D) has a certain relatively low value $S_{CL}$(D,t1), and that the actually outputted control signal $S_{CL}$(A) has a certain value $S_{CL}$(A,t1) close to the average value $S_{AV}$(t1). Because the average value $S_{AV}$(t1) is currently substantially lower than the reference value $S_{REF}$, the maximum value $S_{CL}$(max) is high.

Figure 5B:
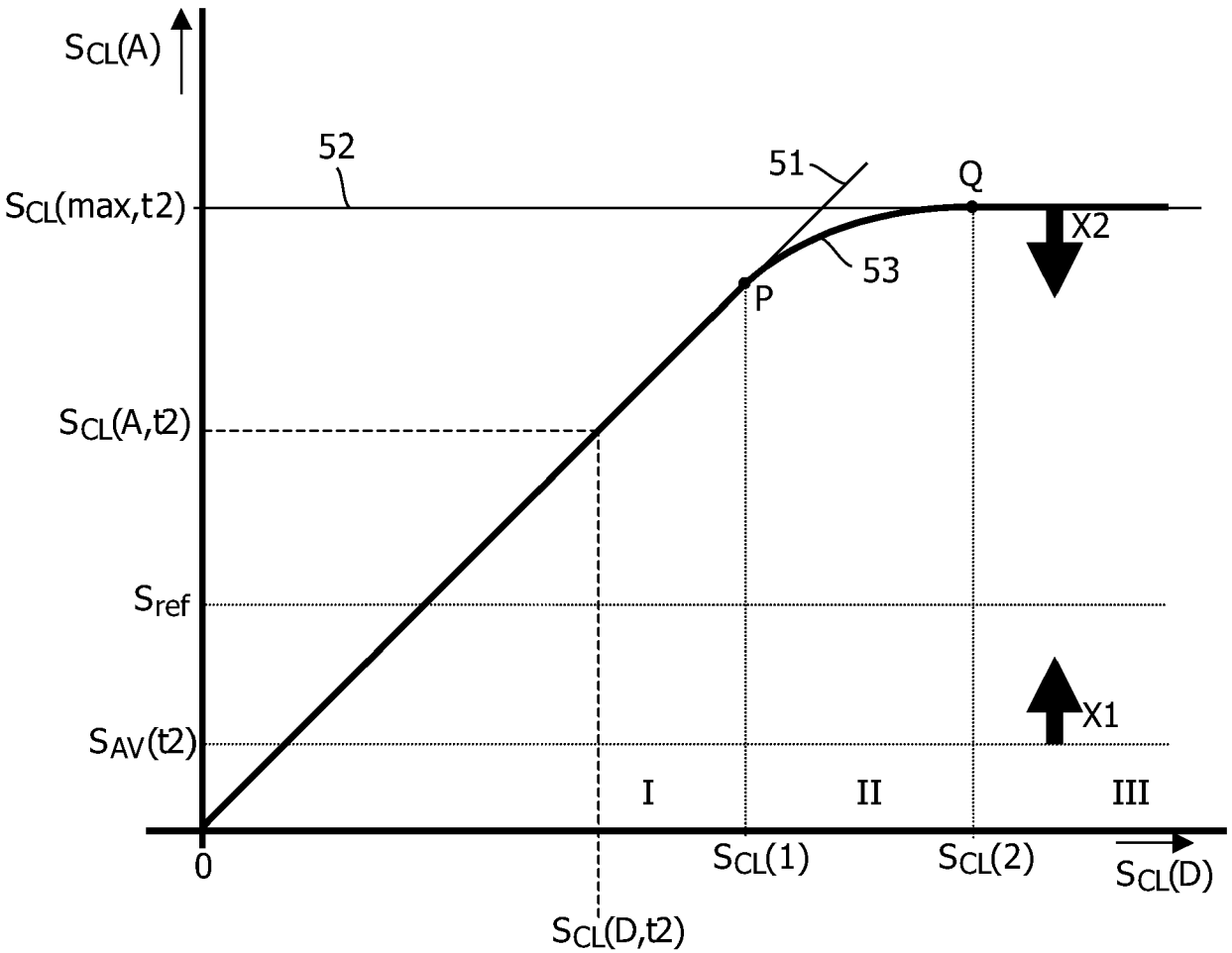

FIG. 5B illustrates the situation at a later time t2. Assume a bright scene, so that the calculated lamp control signal $S_{CL}$(D) has a certain relatively high value $S_{CL}$(D,t2), although (in the example) lower than the first transition value $S_{CL}(1)$. The corresponding actually outputted control signal $S_{CL}$(A,t2) is higher than $S_{CL}$(A,t1), and is even higher than $S_{REF}$: the backlight is boosted.

Figure 5C:
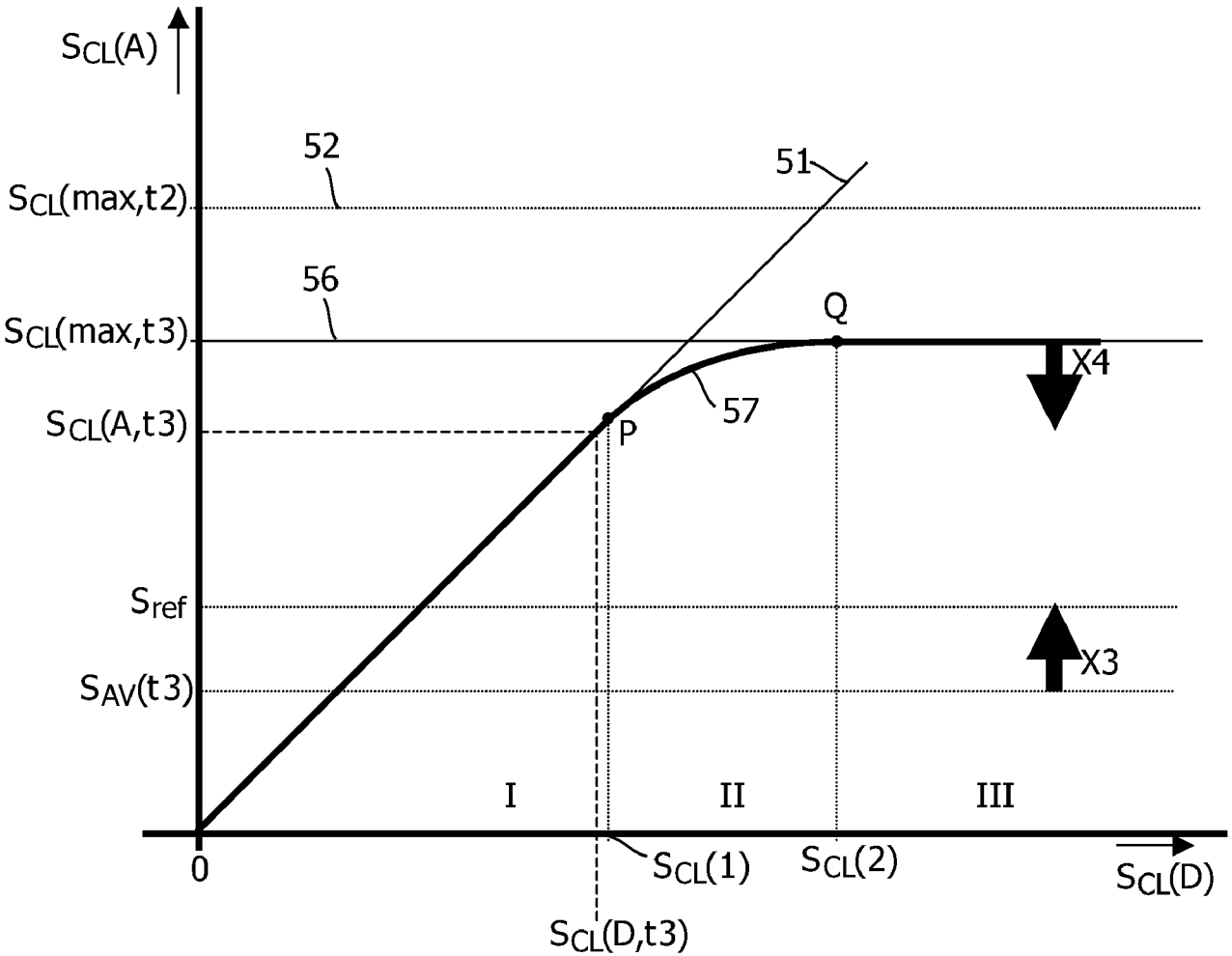

Because the actually outputted control signal $S_{CL}$(A,t2) is higher than $S_{AV}$(t2), the average $S_{AV}$ is increasing (arrow X1), and consequently the maximum value $S_{CL}$(max) is decreasing (arrow X2). FIG. 5C illustrates the situation at a later time t3. It is assumed that the calculated lamp control signal $S_{CL}$(D,t3) on time t3 is equal to $S_{CL}$(D,t2). FIG. 5C illustrates that the average value $S_{AV}$(t3) on time t3 has increased with respect to $S_{AV}$(t2), but it is still lower than the reference value $S_{REF}$. The decreased maximum value $S_{CL}$(max,t3) is indicated by a horizontal line 56 lower than line 52 (shown dotted in FIG. 6), and the resulting controller characteristic is shown by a curve 57. It is noted that, with the decreasing maximum value $S_{CL}$(max), also the first and second transition values $S_{CL}(1)$ and $S_{CL}(2)$ have decreased. In FIG. 5C, the calculated lamp control signal $S_{CL}$(D,t3) is still lower than the first transition value $S_{CL}(1)$, so $S_{CL}$(A,t3) is equal to $S_{CL}$(A,t2).

Figure 5D:
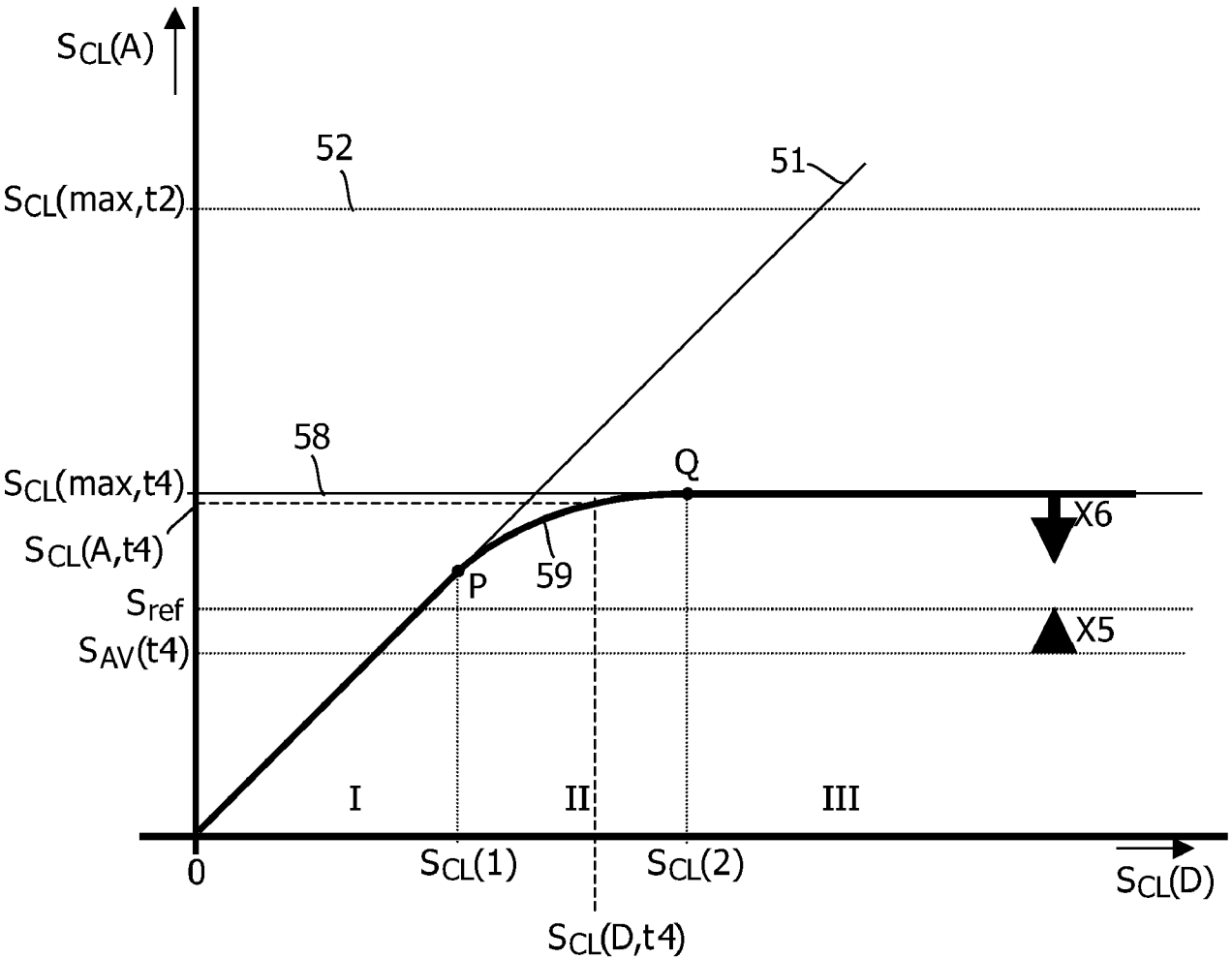

Because the actually outputted control signal $S_{CL}$(A) is still higher than $S_{AV}$, the average $S_{AV}$ is still increasing (arrow X3), and consequently the maximum value $S_{CL}$(max) is still decreasing (arrow X4). FIG. 5D illustrates the situation at a still later time t4. The average value $S_{AV}$(t4) on time t4 has increased with respect to $S_{AV}$(t3), but it is still lower than the reference value $S_{REF}$. The decreased maximum value $S_{CL}$(max,t4) is indicated by a horizontal line 58, and the resulting controller characteristic is shown by a curve 59. It is assumed that the calculated lamp control signal $S_{CL}$(D,t4) on time t4 is still equal to $S_{CL}$(D,t2). The first transition value $S_{CL}$(1) is now lower than the calculated lamp control signal $S_{CL}$(D,t4), and consequently the actually outputted control signal $S_{CL}$(A,t4) is lower than $S_{CL}$(A,t3).

Although the actually outputted control signal $S_{CL}$(A,t4) is reduced with respect to $S_{CL}$(A,t3), it is still higher than $S_{AV}$, so the average $S_{AV}$ is still increasing (arrow X5), and consequently the maximum value $S_{CL}$(max) is still decreasing (arrow X6). It should be clear that, with the decreasing maximum value $S_{CL}$(max), also the actually outputted control signal $S_{CL}$(A,t4) is decreasing, so that the rate of increase of the average $S_{AV}$ is decreasing.

Figure 5E:
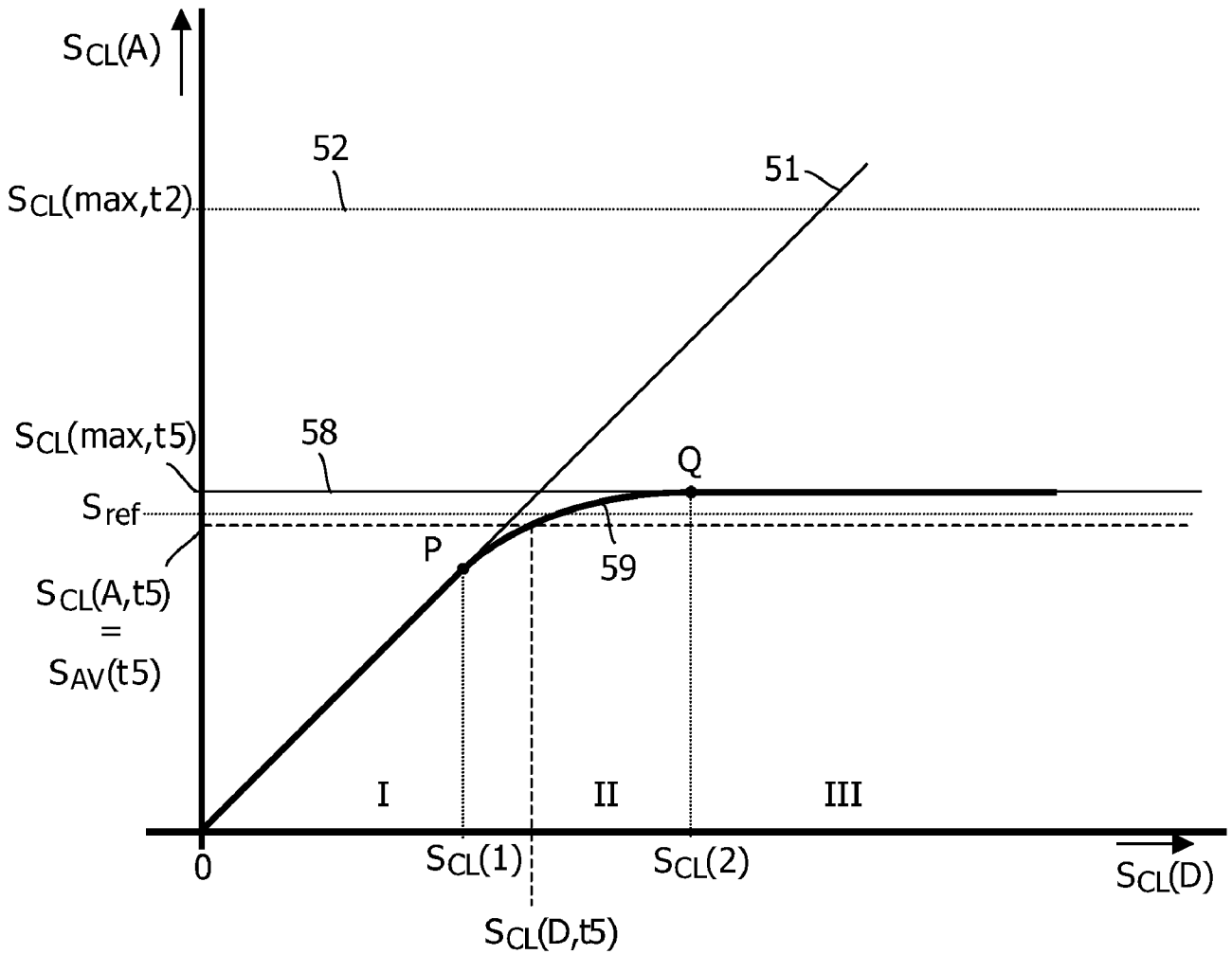

FIG. 5E illustrates that a steady state is reached when the actually outputted control signal $S_{CL}$(A) is equal to the average $S_{AV}$. When that happens, the average $S_{AV}$ will be close to but lower than $S_{REF}$. Thus, on average, the power consumed by the backlight does not exceed a predetermined power rating corresponding to $S_{REF}$.

The predetermined reference value $S_{REF}$ can be a design parameter, or a parameter that can be set by the user. In one embodiment, the predetermined reference value $S_{REF}$ can be equal to the original nominal design power of the backlight, indicated as 100%. However, in another embodiment the predetermined reference value $S_{REF}$ can be set to a lower value, for instance 70%. In that case, occasional backlight boosting to values of 100% or more can be combined with the guarantee that the overall power consumption is reduced. Of course, the amount of backlight boost, in terms of percentage or duration, depends on the history of dark scenes as well as on the setting of the reference value $S_{REF}$, as should be clear to a person skilled in the art.

When the above-mentioned steady state is reached, i.e. when the actually outputted control signal $S_{CL}$(A) is equal to the average $S_{AV}$, backlight boosting is no longer possible. It can be said that the energy reserve is exhausted. Only when further dark scenes happen, the backlight is dimmed, as explained earlier, so that the average power consumption decreases. Simultaneously, the maximum value $S_{CL}$(max) is increased, and backlight boosting becomes possible again. The lower the average power consumed over the recent time period is at the moment when backlight boosting is requested, the further the backlight intensity can be increased, or an the longer the increased intensity can be maintained.

By decreasing the maximum value $S_{CL}$(max), instead of simply reducing the actual backlight intensity, the result is that the boosting of the brightest scenes is limited first, whereas the less bright scenes can be boosted longer.

It should be clear to a person skilled in the art that the present invention is not limited to the exemplary embodiments discussed above, but that several variations and modifications are possible within the protective scope of the invention as defined in the appending claims. For instance, in FIG. 3 the feedback loop 130 is shown as being external to the controller 120, but the feedback loop 130 may alternatively be integral part of the controller 120.

It is noted that amending the maximum value $S_{CL}$(max) can be done at predetermined time intervals, for instance 60 times per second, or continuously.

In the above, it was mentioned that the controller 120 sets the maximum value $S_{CL}$(max) proportional to the difference ($S_{REF}$−$S_{AV}$). The function that describes the relationship between $S_{CL}$(max) and the difference ($S_{REF}$−$S_{AV}$) may be a linear, first order function. However, this function may also comprise second order or higher order terms. The function may also have a zero-th order term unequal to zero.

In the above, the present invention has been explained with reference to block diagrams, which illustrate functional blocks of the device according to the present invention. It is to be understood that one or more of these functional blocks may be implemented in hardware, where the function of such functional block is performed by individual hardware components, but it is also possible that one or more of these functional blocks are implemented in software, so that the function of such functional block is performed by one or more program lines of a computer program or a programmable device such as a microprocessor, microcontroller, digital signal processor, etc.

The invention claimed is:

1. A method for driving an image display device comprising at least one backlight lamp and a display screen, the method comprising the acts of:

receiving an image data signal;

based on the image data signal, calculating a content-related backlight control signal for the backlight lamp for setting intensity of the backlight lamp;

generating an average signal that represents a time-average of power consumed by the backlight lamp;

comparing the average signal with a reference signal;

based on the calculated content-related backlight control signal, taking into account result of the said comparing act, generating an actual backlight control signal for the backlight lamp, wherein the act of generating the actual backlight control signal comprises the acts of:

setting a maximum value for the actual backlight control signal;

defining a first transition value and a second transition value higher than or equal to the first transition value;

generating the actual backlight control signal equal to ξ times the calculated content-related backlight control signal if the calculated content-related backlight control signal is less than the first transition value, wherein ξ is a predetermined factor;

generating the actual backlight control signal equal to the maximum value if the calculated content-related backlight control signal is higher than the second transition value;

generating the actual backlight control signal to have a value lower than ξ times the calculated content-related backlight control signal and lower than the maximum value if the calculated content-related backlight control signal is between the first transition value and the second transition value, and increasing the maximum value when the average signal is lower than the reference signal.

2. The method according to claim 1, wherein, if the image data signal represents dark scenes, the backlight is dimmed, whereas if the image data signal represents bright scenes, the backlight is boosted;

wherein the amount of boost is limited such that the time-average of the power consumed by the backlight lamp does not exceed a predetermined level.

3. The method according to claim 1, wherein ξ is equal to 1.

4. The method according to claim 1, wherein, between the first transition value and the second transition value, a function that describes a relationship between the generated actual backlight control signal and the calculated content-related backlight control signal has a second derivative that is always negative.

5. The method according to claim 1, wherein the function that describes the relationship between the generated actual backlight control signal and the calculated content-related backlight control signal is a continuous function.

6. The method according to claim 1, wherein the function that describes the relationship between the generated actual backlight control signal and the calculated content-related backlight control signal can be continuously differentiated.

7. The method according to claim 1, wherein, if the average signal is higher than the reference signal, the maximum value is reduced.

8. The method according to claim 1, wherein the maximum value is proportional to a difference between the reference signal and the average signal.

9. The method according to claim 1, wherein, at a certain time, the average signal represents power actually consumed by the backlight lamp averaged over a time period with a predetermined duration immediately before said time.

10. The method according to claim 1, further comprising the acts of:

based on the image data signal, generating a screen control signal for the display screen;

if the screen control signals of an image are within a range lower than a maximally possible value, increasing the screen control signals while decreasing the calculated content-related backlight control signal.

11. A display apparatus, comprising an image display device including at least one backlight lamp and a display screen, the apparatus comprising a controller having:

a light output coupled to the backlight lamp for providing a content-related backlight control signal, a pixel control output coupled to the display screen for providing pixel control signals;

an image input for receiving an image data signal, a reference input for receiving a reference signal, a power average input for receiving an average signal; and a calculator configured to calculate the average signal representing a time-average of power consumption by the backlight lamp, the calculator being coupled to the power average input of the controller;

wherein the controller is configured to perform the acts of:

receiving the image data signal;

based on the image data signal, calculating the content-related backlight control signal for the backlight lamp for setting intensity of the backlight lamp;

generating the average signal;

comparing the average signal with the reference signal to form a comparison result;

based on the calculated content-related backlight control signal and the comparison result, generating an actual backlight control signal for the backlight lamp, wherein the act of generating the actual backlight control signal comprises the acts of:

setting a maximum value for the actual backlight control signal;

defining a first transition value and a second transition value higher than or equal to the first transition value;

generating the actual backlight control signal equal to $\xi$ times the calculated content-related backlight control signal if the calculated content-related backlight control signal is less than the first transition value, wherein $\xi$ is a predetermined factor;

generating the actual backlight control signal equal to the maximum value if the calculated content-related backlight control signal is higher than the second transition value;

generating the actual backlight control signal to have a value lower than $\xi$ times the calculated content-related backlight control signal and lower than the maximum value if the calculated content-related backlight control signal is between the first transition value and the second transition value, and increasing the maximum value when the average signal is lower than the reference signal.

12. The display according to claim 11, wherein said calculator is incorporated in a feedback loop having an input coupled to the light output of the controller.

* * * * *